US007148872B2

(12) United States Patent
Yamashita et al.

(10) Patent No.: US 7,148,872 B2
(45) Date of Patent: Dec. 12, 2006

(54) DISPLAY APPARATUS FOR SEQUENTIAL PIXEL SAMPLING INCLUDING ATTENUATED CAPACITIVE COUPLING BETWEEN SIGNAL LINES

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 376 days.

(21) Appl. No.: 10/442,007

(22) Filed: May 20, 2003

(65) Prior Publication Data

US 2004/0012555 A1 Jan. 22, 2004

(30) Foreign Application Priority Data

May 21, 2002 (JP) ..... 2002-145620

(51) Int. Cl.
*G09G 3/36* (2006.01)

(52) U.S. Cl. ..... 345/100; 345/93; 345/98

(58) Field of Classification Search ..... 345/87–104, 345/204–215

See application file for complete search history.

(56) References Cited

U.S. PATENT DOCUMENTS 5,764,207 A * 6/1998 Maekawa et al. ..... 345/99
6,356,253 B1 * 3/2002 Uchino et al. ..... 345/89
2002/0149558 A1 * 10/2002 Kashima et al. ..... 345/100

* cited by examiner

*Primary Examiner*—Vijay Shankar
(74) *Attorney, Agent, or Firm*—Robert J. Depke; Rockey, Depke, Lyons & Kitzinger LLC

(57) ABSTRACT

The present invention provides a display apparatus including a pixel array unit, a vertical driving circuit, and a horizontal driving circuit. The horizontal driving circuit includes a shift register for performing shift operation in synchronism with the clock signal and sequentially outputting shift pulses from respective shift stages, a shaping switch group for shaping the shift pulses sequentially outputted from the shift register and sequentially outputting non-overlap sampling pulses temporally separated from each other, and a sampling switch group for sequentially sampling the input video signal in a non-overlapping manner in response to the sampling pulses and supplying the sampled video signal to each of the signal lines. A capacitance interposed between adjacent signal lines is connected to wiring of lower impedance than a signal line side, thereby attenuating capacitive coupling between the adjacent signal lines and thus suppressing the potential variation of the video signal sampled in a non-overlapping manner and supplied to the signal lines.

7 Claims, 13 Drawing Sheets

DISPLAY APPARATUS FOR SEQUENTIAL PIXEL SAMPLING INCLUDING ATTENUATED CAPACITIVE COUPLING BETWEEN SIGNAL LINES

This application claims priority to Japanese Patent Application Number JP 2002-145620 filed May 21, 2002 which is incorporated herein by reference.

BACKGROUND OF THE INVENTION

The present invention relates to a display apparatus, and particularly to a dot-sequential driving active matrix display apparatus using a so-called non-overlap sampling method for a horizontal driving circuit thereof.

In a display apparatus, for example an active matrix liquid crystal display apparatus using a liquid crystal cell as a display element (electro-optical element) of a pixel, a horizontal driving circuit of a dot-sequential driving type using a clock driving method, for example, is known. FIG. 8 shows a conventional example of the clock driving type horizontal driving circuit. In FIG. 8, the horizontal driving circuit 100 has a shift register 101, a clock extracting switch group 102, and a sampling switch group 103.

The shift register 101 includes n shift stages (transfer stages). When a horizontal start pulse HST is supplied to the shift register 101, the shift register 101 performs shift operation in synchronism with horizontal clocks HCK and HCKX opposite to each other in phase. Thereby, as shown in a timing chart of FIG. 9, the shift stages of the shift register 101 sequentially output shift pulses Vs1 to Vsn having a pulse width equal to a cycle of the horizontal clocks HCK and HCKX. The shift pulses Vs1 to Vsn are supplied to switches 102-1 to 102-n of the clock extracting switch group 102.

The switches 102-1 to 102-n of the clock extracting switch group 102 are alternately connected at one terminal thereof to clock lines 104-1 and 104-2 that input the horizontal clocks HCKX and HCK. By being supplied with the shift pulses Vs1 to Vsn from the shift stages of the shift register 101, the switches 102-1 to 102-n of the clock extracting switch group 102 are sequentially turned on to sequentially extract the horizontal clocks HCKX and HCK. The extracted pulses are supplied as sampling pulses Vh1 to Vhn to switches 103-1 to 103-n of the sampling switch group 103.

The switches 103-1 to 103-n of the sampling switch group 103 are each connected at one terminal thereof to a video line 105 for transmitting a video signal "video". The switches 103-1 to 103-n of the sampling switch group 103 are sequentially turned on in response to the sampling pulses Vh1 to Vhn extracted and sequentially supplied by the switches 102-1 to 102-n of the clock extracting switch group 102, thereby sample the video signal "video", and then supply the sampled video signal. "video" to signal lines 106-1 to 106-n of a pixel array unit (not shown).

In the clock driving type horizontal driving circuit 100 according to the foregoing conventional example, a delay is caused in the sampling pulses Vh1 to Vhn by wiring resistance, parasitic capacitance, and the like in a transmission process from the extraction of the horizontal clocks HCKX and HCK by the switches 102-1 to 102-n of the clock extracting switch group 102 to the supply of the horizontal clocks HCKX and HCK as the sampling pulses Vh1 to Vhn to the switches 103-1 to 103-n of the sampling switch group 103.

The delay in the sampling pulses Vh1 to Vhn in the transmission process causes waveforms of the sampling pulses Vh1 to Vhn to be rounded. As a result, directing attention to the sampling pulse Vh2 in the second stage, for example, as is particularly clear from a timing chart of FIG. 10, the waveform of the sampling pulse Vh2 in the second stage overlaps the waveforms of the preceding and succeeding sampling pulses Vh1 and Vh3 in the first stage and the third'stage.

In general, as shown in FIG. 10, charge and discharge noise is superimposed on the video line 105 at an instant when each of the switches 103-1 to 103-n of the sampling switch group 103 is turned on, because of a relation in potential between the video line 105 and the signal lines 106-1 to 106-n.

In such a situation, when the sampling pulse Vh2 overlaps the sampling pulses in the preceding and succeeding stages, as described above, charge and discharge noise caused by turning on the sampling switch 103-3 in the third stage is sampled in sampling timing of the second stage based on the sampling pulse Vh2. The sampling switches 103-1 to 103-n sample and hold the potential of the video line 105 in timing in which the sampling pulses Vh1 to Vhn reach an "L" level.

In this case, since the charge and discharge noise superimposed on the video line 105 is varied and also the timing in which each of the sampling pulses Vh1 to Vhn reaches the "L" level is varied, the potential sampled by the sampling switches 103-1 to 103-n is varied. As a result, the variation in the sampled potential appears as a vertical streak on the display screen, thus degrading picture quality.

When the number of pixels in a horizontal direction, in particular, is increased with higher definition in the active matrix liquid crystal display apparatus of the dot-sequential driving type, it is difficult to secure a sufficient sampling time for the sequential sampling for all the pixels of the video signal "video" inputted by one system within a limited horizontal effective period. Accordingly, in order to secure a sufficient sampling time, as shown in FIG. 11, a method is used in which video signals are inputted in parallel by m systems (m is an integer of 2 or more), and with m pixels in the horizontal direction as a unit, m sampling switches are provided and driven simultaneously by one sampling pulse, whereby sequential writing in units of m pixels is performed.

With such a method of simultaneously driving a plurality of pixels, a ghost tends to occur when sampling pulses overlap each other as described above. The ghost refers to an undesired interference image displaced from and overlapping a normal image. The conventional driving method that may cause the overlapping has a small ghost margin.

As described above, the active matrix display apparatus of the dot-sequential type conventionally has problems of the vertical streak defect and the insufficient ghost margin. Accordingly, in order to eliminate the vertical streak and increase the ghost margin, a non-overlap sampling method is disclosed in Japanese Patent Laid-Open No. 2002-072987. FIGS. 12A and 12B are a circuit diagram showing an example of a display apparatus using the non-overlap sampling method and a waveform chart. As shown in FIG. 12A, the display apparatus includes a pixel array unit, a vertical driving circuit 16, and a horizontal driving circuit 17. The pixel array unit includes gate lines 13 in a form of rows, signal lines 12 in a form of columns, and pixels 11 arranged in a form of a matrix at intersections of the gate lines 13 and the signal lines 12. The vertical driving circuit 16 is connected to the gate lines 13 to sequentially select rows of the pixels 11. The horizontal driving circuit 17 is connected to the signal lines 12. The horizontal driving circuit 17 operates on the basis of a predetermined clock signal to sequentially write a video signal to pixels 11 of a selected row. In this example, the video signal is divided into two systems video-a and video-b; thus, a two-pixel simultaneous driving method is used.

The horizontal driving circuit 17 includes a shift register 21, a shaping switch group 22, and a sampling switch group 23. The shift register 21 performs shift operation in synchronism with externally inputted clock signals to sequentially output a shift pulse from each of shift stages thereof. The shaping switch group 22 shapes the shift pulses sequentially outputted from the shift register 21 to sequentially output non-overlapping sampling pulses Vh1 and Vh2 temporally separated from each other. In the example shown in FIG. 12A, the sampling pulse Vh1 is outputted from an N stage and the sampling pulse Vh2 is outputted from a next N+1 stage. In response to the sampling pulses Vh1 and Vh2, the sampling switch group 23 sequentially samples the input video signals video-a and video-b in a non-overlapping manner. The sampling switch group 23 then supplies the sampled video signals video-a and video-b to the signal lines 12. In the example shown in FIG. 12A, a sampling switch 23-1 samples the video signals video-a and video-b in response to the sampling pulse Vh1 and supplies the sampled video signals video-a and video-b to two signal lines (1) and (2), respectively. A next sampling switch 23-2 operates in response to the sampling pulse Vh2 to sample the video signals video-a and video-b and supply the sampled video signals video-a and video-b to signal lines (3) and (4), respectively.

However, a new picture quality defect is caused by the introduction of this non-overlap sampling driving. This will be briefly described with reference to FIG. 12B. As shown in the figure, the sampling pulse Vh1 outputted from the N stage and the sampling pulse Vh2 outputted from the next N+1 stage are temporally separated from each other, thus enabling non-overlap sampling. In response to the sampling pulse Vh1, the video signal video-b is sampled and supplied to the signal line (2). The potential of the signal line (2) is represented as Vsig1-b in the waveform chart. In response to the next sampling pulse Vh2, the video signal video-a is sampled and supplied to the third signal line (3). The potential change of the signal line (3) is represented as Vsig2-a.

It is generally known that a parasitic capacitance exists between adjacent signal lines. In FIG. 12A, a parasitic capacitance between signal lines is denoted by C. A capacitance of each signal line is denoted by Csig. In non-overlap sampling, the potential Vsig1-b of the signal line (2) in the preceding stage is held first, and thereafter the input video signal video-a is written to the signal line (3) in the succeeding stage. At this time, capacitive coupling is introduced from the signal line (3) in the succeeding stage to the signal line (2) in the preceding stage via the parasitic capacitance C between the signal lines, whereby a vertical streak occurs. Letting ΔV be the potential change of the signal line (2) in the preceding stage, which potential change is caused by the capacitive coupling, and ΔVsig be the potential written to the signal line (3) in the succeeding stage, the potential variation causing the vertical streak is expressed as $\Delta V = C \cdot \Delta Vsig/(C+Csig)$. As is clear from this equation, the greater the potential difference written to each signal line, the greater the potential variation ΔV caused by coupling between the signal lines. Of course, the larger the parasitic capacitance C between the signal lines, the greater the potential variation ΔV.

FIG. 13 schematically shows the new picture quality defect caused by introducing non-overlap sampling driving. In the example shown in FIG. 13, six-pixel simultaneous driving is performed, and therefore non-overlap sampling is performed with six columns of pixels 11 taken as one unit. At each unit boundary portion of the multistage-connected shift register, a potential jump occurs via a parasitic capacitance between adjacent signal lines, resulting in a vertical streak in a one-pixel column of each unit. Because of a mechanism of occurrence of the vertical streak, the vertical streak is caused between adjacent signal lines at a boundary between units. As viewed from a direction of horizontal scanning, a potential jump occurs into the signal line in the preceding stage from the signal line in the succeeding stage via a parasitic capacitance. Thus, as shown in FIG. 13, when pixels 11 are scanned from the left to the right, a picture quality defect referred to as a vertical streak occurs in a rightmost pixel column of each unit. When the pixel array unit 15 is scanned from the right to the left, on the other hand, a vertical streak appears in a leftmost pixel column of each unit. This vertical streak defect cannot be completely eliminated even when the potential of each signal line is adjusted in advance by a precharge signal, thus presenting a problem to be solved.

SUMMARY OF THE INVENTION

In order to solve the above problem of the related art, the following means are provided. That is, there is provided a display apparatus including: a pixel array unit having gate lines in a form of rows, signal lines in a form of columns, and pixels arranged in a form of a matrix at intersections of the gate lines and the signal lines; a vertical driving circuit connected to the gate lines, for sequentially selecting rows of the pixels; and a horizontal driving circuit connected to the signal lines, for operating on the basis of a predetermined clock signal and sequentially writing a video signal to pixels of a selected row. The horizontal driving circuit includes: a shift register for performing shift operation in synchronism with the clock signal and sequentially outputting shift pulses from respective shift stages; a shaping switch group for shaping the shift pulses sequentially outputted from the shift register and sequentially outputting non-overlap sampling pulses temporally separated from each other; and a sampling switch group for sequentially sampling the input video signal in a non-overlapping manner in response to the sampling pulses and supplying the sampled video signal to each of the signal lines. A capacitance interposed between adjacent signal lines is connected to wiring of lower impedance than a signal line side, thereby attenuating capacitive coupling between the adjacent signal lines and thus suppressing the potential variation of the video signal sampled in a non-overlapping manner and supplied to the signal lines.

Specifically, the capacitance interposed between the signal lines is formed by a conductor film disposed over the adjacent signal lines via an insulating film, and the conductor film is connected to the wiring of lower impedance than the signal line side, thereby attenuating the capacitive coupling between the adjacent signal lines. The conductor film is formed by polysilicon for blocking light between the adjacent signal lines, for example. The pixel includes a pixel electrode connected to a signal line via a switching element and a counter electrode opposed to the pixel electrode with electro-optical material between the counter electrode and the pixel electrode, and the conductor film is connected to wiring for supplying a predetermined potential to the counter electrode.

According to the present invention, in the dot-sequential type active matrix display apparatus, the capacitance interposed between the adjacent signal lines is connected to the wiring of low impedance. With this layout, it is possible to suppress the picture defect in the form of a vertical streak caused by coupling between the adjacent signal lines even when performing non-overlap sampling driving introduced as a measure against the vertical streak and for increasing the ghost margin.

BRIEF DESCRIPTION OF THE DRAWINGS

These and other objects of the invention will be seen by reference to the description, taken in connection with the accompanying drawing, in which.

DETAILED DESCRIPTION OF THE PREFERRED EMBODIMENT

Figure 1A:
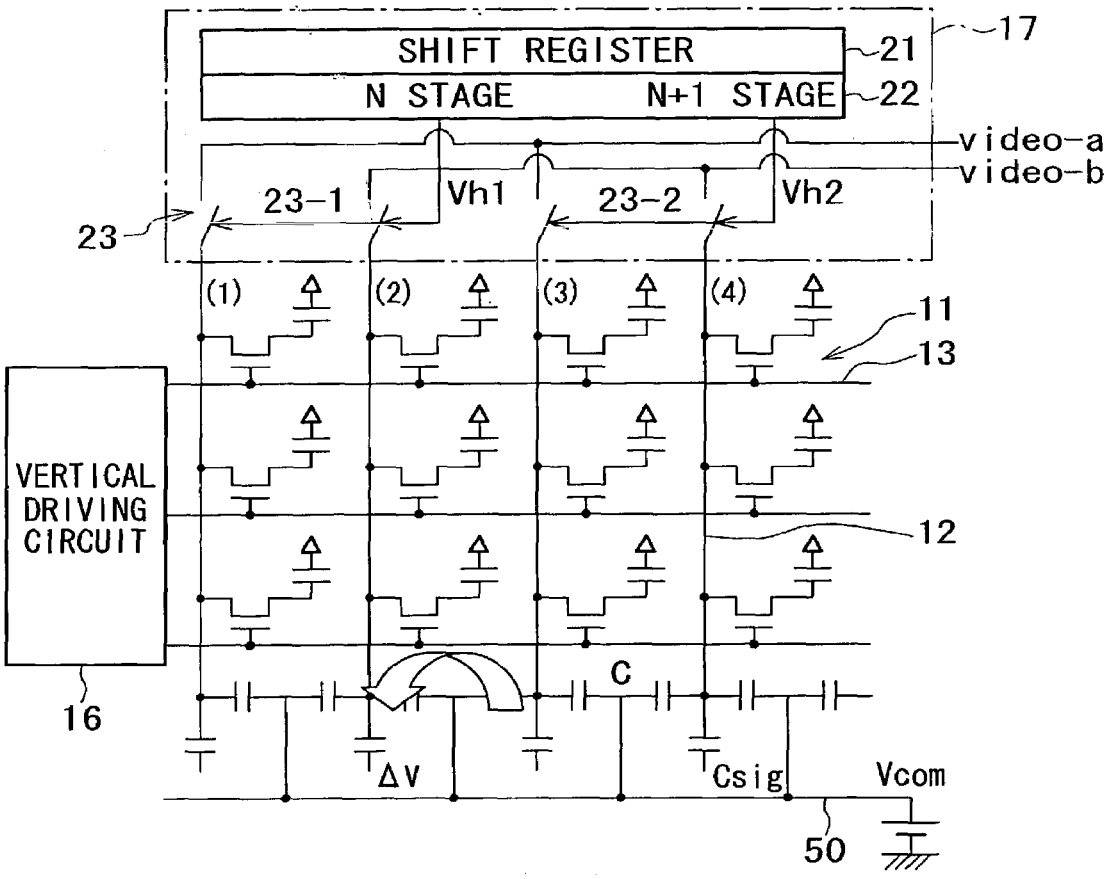
FIGS. 1A and 1B are schematic diagrams showing a configuration and operation of a display apparatus according to the present invention.
Figure 1B:
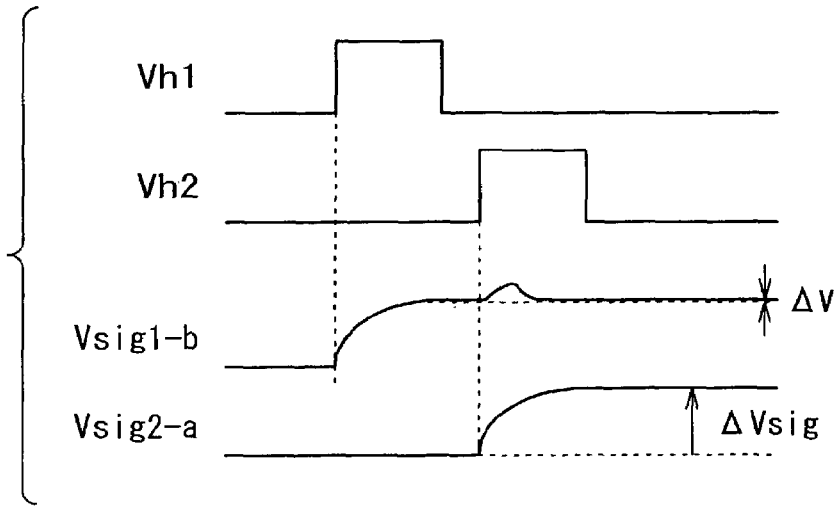

A preferred embodiment of the present invention will hereinafter be described in detail. FIGS. 1A and 1B are respectively a schematic block diagram showing a basic configuration of a display apparatus according to the present invention and a waveform chart. As shown in FIG. 1A, the display apparatus includes a pixel array unit, a vertical driving circuit 16, and a horizontal driving circuit 17. The pixel array unit includes gate lines 13 in a form of rows, signal lines 12 in a form of columns, and pixels 11 arranged in a form of a matrix at intersections of the gate lines 13 and the signal lines 12. In the present embodiment, a pixel 11 includes a switching element formed by a thin film transistor and a liquid crystal cell. The thin film transistor has a gate electrode connected to a corresponding gate line 13, a source electrode connected to a corresponding signal line 12, and a drain electrode connected to a corresponding liquid crystal cell. The liquid crystal cell includes a pixel electrode connected to the drain electrode and a counter electrode opposed to the pixel electrode. A liquid crystal is interposed as electro-optical material between the counter electrode and the pixel electrode. The vertical driving circuit 16 is connected to each of the gate lines 13 to sequentially select rows of the pixels 11. The horizontal driving circuit 17 is connected to each of the signal lines 12. The horizontal driving circuit 17 operates on the basis of a predetermined clock signal to sequentially write a video signal to pixels 11 of a selected row. In the present embodiment, the video signal is divided into two systems video-a and video-b; thus, a so-called two-pixel simultaneous driving method is used. However, the present invention is not limited to this, and the number of pixels driven simultaneously is not specifically limited. Incidentally, the signal lines 12 are sequentially identified by (1), (2), (3), (4) . . . from the left to the right along a direction of horizontal scanning.

The horizontal driving circuit 17 includes a shift register 21, a shaping switch group 22, and a sampling switch group 23. The shift register 21 performs shift operation on an externally supplied start pulse in synchronism with externally supplied clock signals to sequentially output a shift pulse from each of shift stages thereof. The shaping switch group 22 shapes the shift pulses sequentially outputted from the shift register 21 to sequentially output non-overlap sampling pulses temporally separated from each other. In the example shown in FIG. 1A, a sampling pulse Vh1 outputted from an N stage of the shaping switch group 22 and a next sampling pulse Vh2 outputted from an N+1 stage of the shaping switch group 22 are schematically shown. The sampling pulse Vh1 from the preceding stage and the sampling pulse Vh2 from the succeeding stage are temporally separated from each other, and are thus non-overlap sampling pulses. In response to the sampling pulses Vh1, Vh2 . . . , the sampling switch group 23 sequentially samples the input video signals video-a and video-b in a non-overlapping manner. The sampling switch group 23 then supplies the video signals video-a and video-b to the signal lines (1), (2), (3), (4) . . . respectively. In the present embodiment, a sampling switch 23-1 corresponding to the N stage operates in response to the sampling pulse Vh1 to simultaneously sample the video signals video-a and video-b and supply the sampled video signals video-a and video-b to the signal lines (1) and (2), respectively. Then a sampling switch 23-2 corresponding to the N+1 stage operates in response to the next sampling pulse Vh2 to simultaneously sample the video signals video-a and video-b and supply the sampled video signals video-a and video-b to the signal lines (3) and (4), respectively.

As a feature of the present invention, a capacitance C interposed between adjacent signal lines 12 is connected to wiring 50 of lower impedance than the signal line 12 side to thereby attenuate capacitive coupling between the adjacent signal lines 12 and thus suppress the potential variation $\Delta V$ of the video signals video-a and video-b sampled in a non-overlapping manner and supplied to the signal lines 12. Preferably, the capacitance C interposed between the signal lines is formed by a conductor film (semiconductor film or metallic film) disposed over the adjacent signal lines 12 via an insulating film, and the conductor film is connected to the wiring 50 of lower impedance than the signal line 12 side to thereby attenuate capacitive coupling between the adjacent signal lines. The conductor film is formed by a polysilicon film for blocking light between the adjacent signal lines, for example. In this case, the polysilicon film originally disposed for blocking light forms the parasitic capacitance C between the signal lines, and the capacitive coupling is prevented by connecting the parasitic capacitance C to the wiring 50 of lower impedance. In some cases where the conductor film for blocking light is not originally provided, the potential variations caused by a potential jump between the signal lines can be aggressively suppressed by aggressively disposing the conductor film between the signal lines and connecting the conductor film to the wiring of lower impedance. Incidentally, in the present embodiment, the conductor film forming electrodes of the capacitance C is connected to the wiring 50 for supplying a predetermined counter potential (Vcom) to the counter electrode. Since the polysilicon film for blocking light is originally at a floating potential, a swing in the capacitance C is not suppressed as it is, thus causing a vertical streak. According to the present invention, the parasitic capacitance C between the adjacent signal lines is connected to the low-impedance wiring to form a differentiating circuit, whereby coupling between the adjacent signal lines is attenuated.

FIG. 1B is a waveform chart of assistance in explaining operation of the display apparatus shown in FIG. 1A. The sampling switch 23-1 in the N stage is supplied with the sampling pulse Vh1 shown in the figure. The sampling switch 23-2 corresponding to the N+1 stage is supplied with the next sampling pulse Vh2. As is clear from the waveform chart, the sampling pulses Vh1 and Vh2 are temporally separated from each other, and thus do not overlap each other. Of the signal lines (2) and (3) adjacent to each other, the signal line (2) in the preceding stage is supplied with video-b sampled in response to Vh1. The potential change is represented by Vsig1-b. The signal line (3) in the succeeding stage is supplied with the video signal video-a sampled in response to Vh2. The potential change in the signal line (3) is represented by Vsig2-a. As described above, the capacitance C interposed between the adjacent signal lines (2) and (3) is connected to the low-impedance wiring 50. By thus connecting the capacitance C to the low-impedance wiring, a swing in the capacitance C is quickly attenuated within a horizontal period. Thus, the coupling between the signal line (3) and the adjacent signal line (2) is also quickly attenuated within the horizontal period, reaching the same potential as the potential of the other signal lines 12. It is thereby possible to completely eliminate a vertical streak corresponding to one column of pixels and occurring at each boundary between units.

Figure 2:
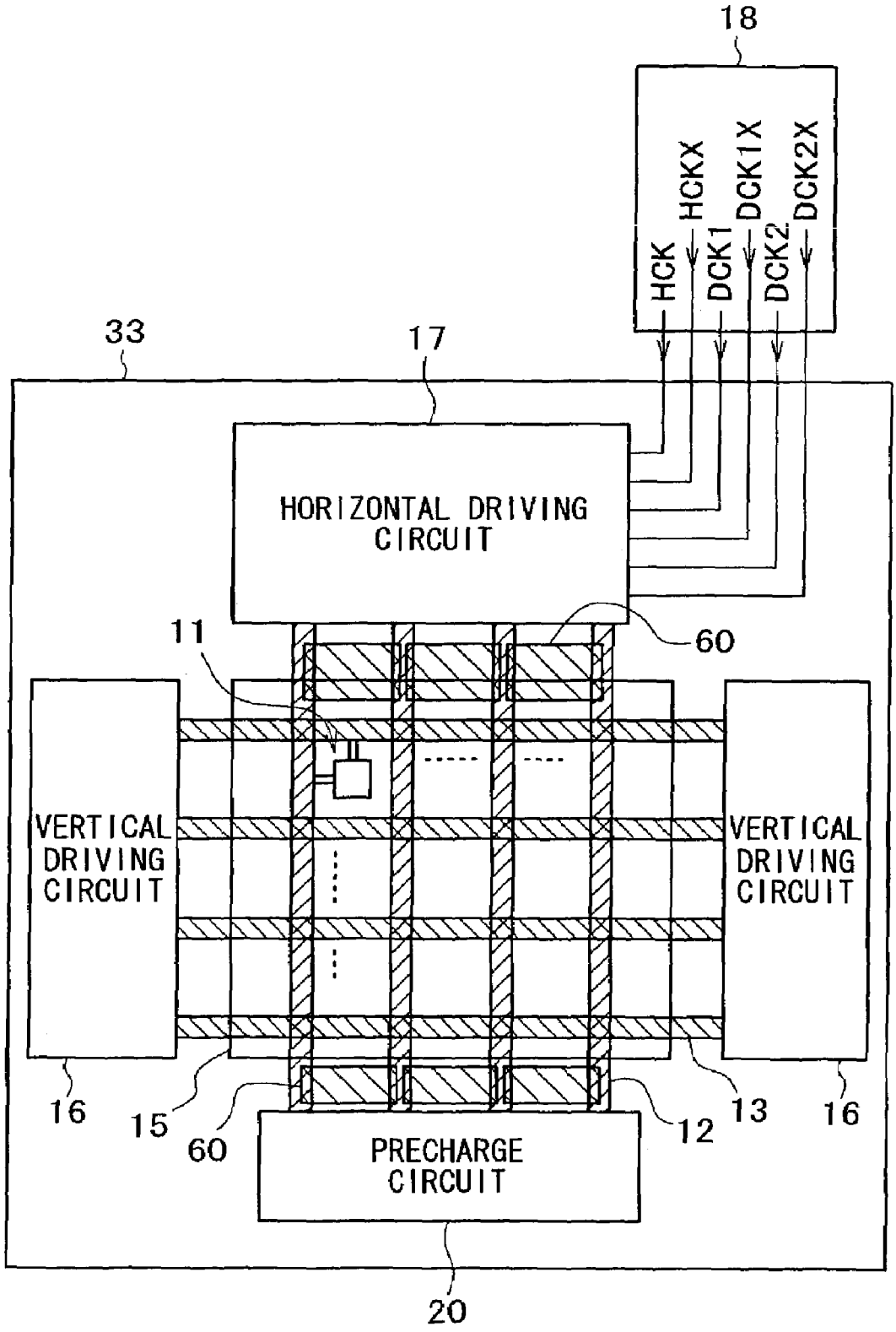
FIG. 2 is a plan view of a panel structure of the display apparatus shown in FIGS. 1A and 1B.

FIG. 2 is a schematic plan view of a panel structure of the display apparatus shown in FIGS. 1A and 1B. As shown in FIG. 2, the display apparatus is formed by a panel 33 having the pixel array unit 15, the vertical driving circuit 16, the horizontal driving circuit 17, and the like formed therein in an integrated manner. The pixel array unit 15 includes the gate lines 13 in the form of rows, the signal lines 12 in the form of columns, and the pixels 11 arranged in the form of a matrix at intersections of the gate lines 13 and the signal lines 12. The vertical driving circuit 16 is divided into circuits disposed on the left and right sides, which circuits are connected to both ends of the gate lines 13 to sequentially select rows of the pixels 11. The horizontal driving circuit 17 is connected to the signal lines 12. The horizontal driving circuit 17 operates on the basis of a clock signal having a predetermined cycle to sequentially write the video signal to the pixels 11 of a selected row. The display apparatus further includes a clock generating circuit 18 outside the panel 33. The clock generating circuit 18 generates first clock signals HCK and HCKX serving as the basis for the operation of the horizontal driving circuit 17, and also generates second clock signals DCK1, DCK1X, DCK2, and DCK2X having the same cycle as the first clock signals HCK and HCKX and having a lower duty ratio than the first clock signals HCK and HCKX. HCKX denotes an inverted signal of HCK. Similarly, DCK1X denotes an inverted signal of DCK1, and DCK2X denotes an inverted signal of DCK2. In addition, a precharge circuit 20 is connected to lower ends of the signal lines 12. The precharge circuit 20 precharges the signal lines 12 to a predetermined potential prior to the sampling of the video signal by the horizontal driving circuit 17 to thereby improve quality of an image displayed on the pixel array unit 15.

The panel 33 generally has multilayer wiring formed by using a semiconductor fabrication process. The multilayer wiring includes the signal lines 12 made of aluminum and the like and other patterns made of titanium and the like. Metallic patterns made of aluminum, titanium, and the like generally have a high reflectivity. In a case where the panel 33 is used for a light valve of a projector, for example, an amount of source light has been increased significantly because of demand for higher brightness. This causes reflection of high-reflectivity metallic patterns of aluminum and titanium formed in the panel 33. As a measure against the reflection in the present embodiment, conductor film 60 made of low-reflectivity polysilicon is laid out over exposed portions of the signal lines 12. In the example shown in FIG. 2, the conductor film 60 made of polysilicon and separated for each line shields from light the pattern of the signal lines 12 appearing in a portion where the horizontal driving circuit 17 and the pixel array unit 15 are connected to each other. Similarly, the conductor film 60 is provided for a portion of the signal lines 12 existing between the precharge circuit 20 and the pixel array unit 15. Since the conductor film 60 made of polysilicon has a lower reflectivity than aluminum, the conductor film 60 is effective as a measure against the problem of the reflection. However, the conductor film 60 is basically in a floating state, and thus accounts for most of the parasitic capacitance between adjacent signal lines. According to the present invention, the conductor film 60 is connected to the wiring of lower impedance than the signal line 12 side to thereby eliminate adverse effects of the parasitic capacitance.

Figure 3:
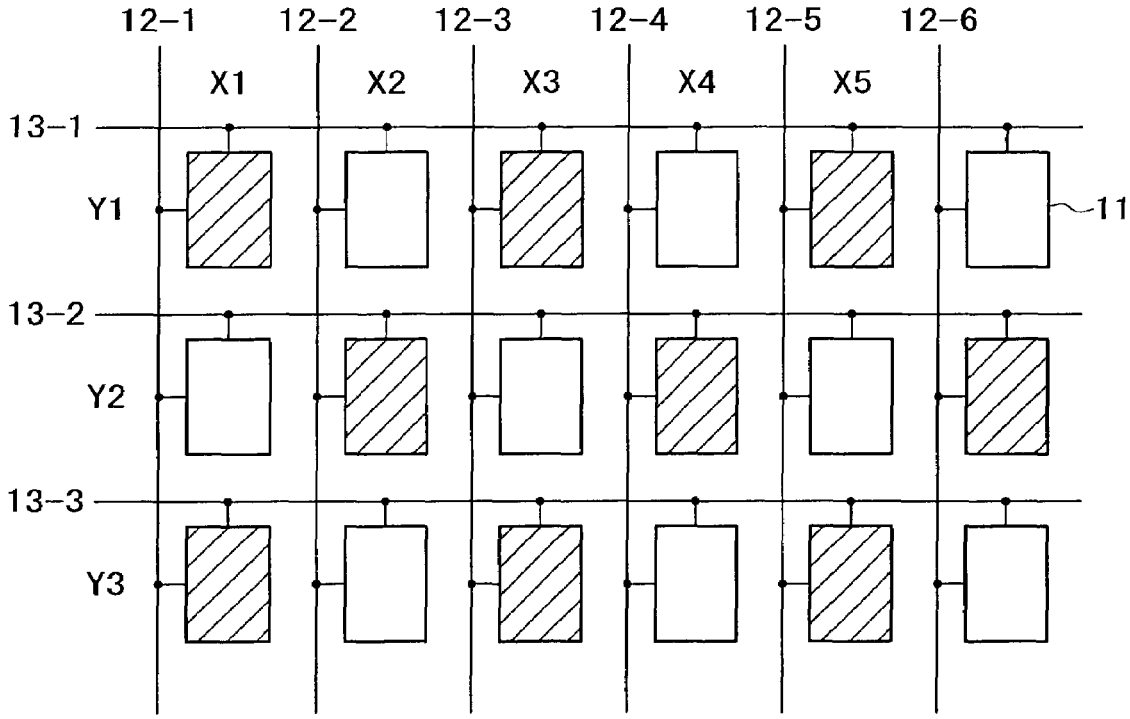
FIG. 3 is a schematic diagram showing an example of an image pattern displayed on the display apparatus shown in FIGS. 1A and 1B and FIG. 2.

A defect of a vertical streak caused by capacitive coupling between signal lines is conspicuous especially when a checkered image pattern is displayed. FIG. 3 shows this state. As shown in the figure, pixels 11 are arranged at intersections of gate lines 13-1, 13-2, and 13-3 in a form of rows and signal lines 12-1, 12-2, 12-3, 12-4, 12-5, and 12-6 in a form of columns. In the figure, the columns of the pixels 11 are indicated by Y1, Y2, and Y3, and the rows of the pixels 11 are indicated by X1, X2, X3, X4, and X5. The checkered image pattern is one in which pixels 11 adjacent to each other have different brightness levels. When such a checkered pattern is displayed, a difference in potential between signal lines is increased, and accordingly a potential variation caused by capacitive coupling between the signal lines is increased, resulting in a defect of a conspicuous vertical streak. According to the present invention, by connecting the capacitance between the signal lines to low-impedance wiring, it is possible to completely eliminate the defect of a vertical streak even when the checkered pattern of FIG. 3 is displayed. Thus, by aggressively disposing the conductor film between signal lines via an insulating film and connecting the conductor film to the wiring of low impedance, it is possible to eliminate the defect of a vertical streak in non-overlap sampling substantially completely, which has conventionally been difficult.

Figure 4:
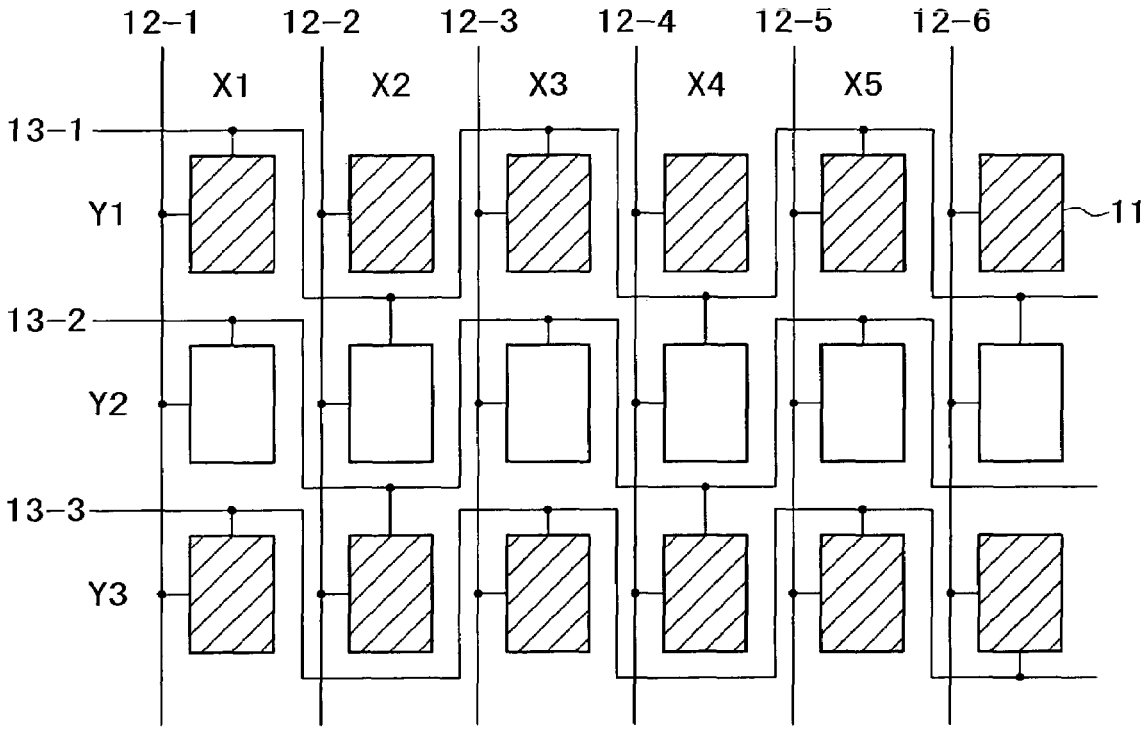
FIG. 4 is a schematic diagram showing an example of an image pattern displayed on the display apparatus shown in FIGS. 1A and 1B and FIG. 2.

FIG. 4 shows an example of a pixel arrangement suitable for so-called dot line reversal driving. In order to facilitate understanding, parts corresponding to those in the normal pixel arrangement shown in FIG. 3 are identified by corresponding reference numerals. In dot line reversal driving, pixels 11 connected to the same gate line are disposed so as to alternate in each column between adjacent rows. For example, when attention is directed to a gate line 13-1, a pixel (X1, Y1) belongs to a row Y1; a next pixel (X2, Y2) belongs to a row Y2; a succeeding pixel (X3, Y1) belongs to the row Y1; and further a pixel (X4, Y2) belongs to the row Y2. In such a pixel arrangement, when a stripe pattern in which brightness changes alternately in each row is displayed as shown in FIG. 4, a relation in potential between adjacent signal lines is the same as the state shown in FIG. 3. A defect of a vertical streak is most likely to appear in this pattern. Also in this case, by connecting the capacitance interposed between signal lines to wiring of low impedance, it is possible to eliminate the defect of a vertical streak substantially completely.

Figure 5:
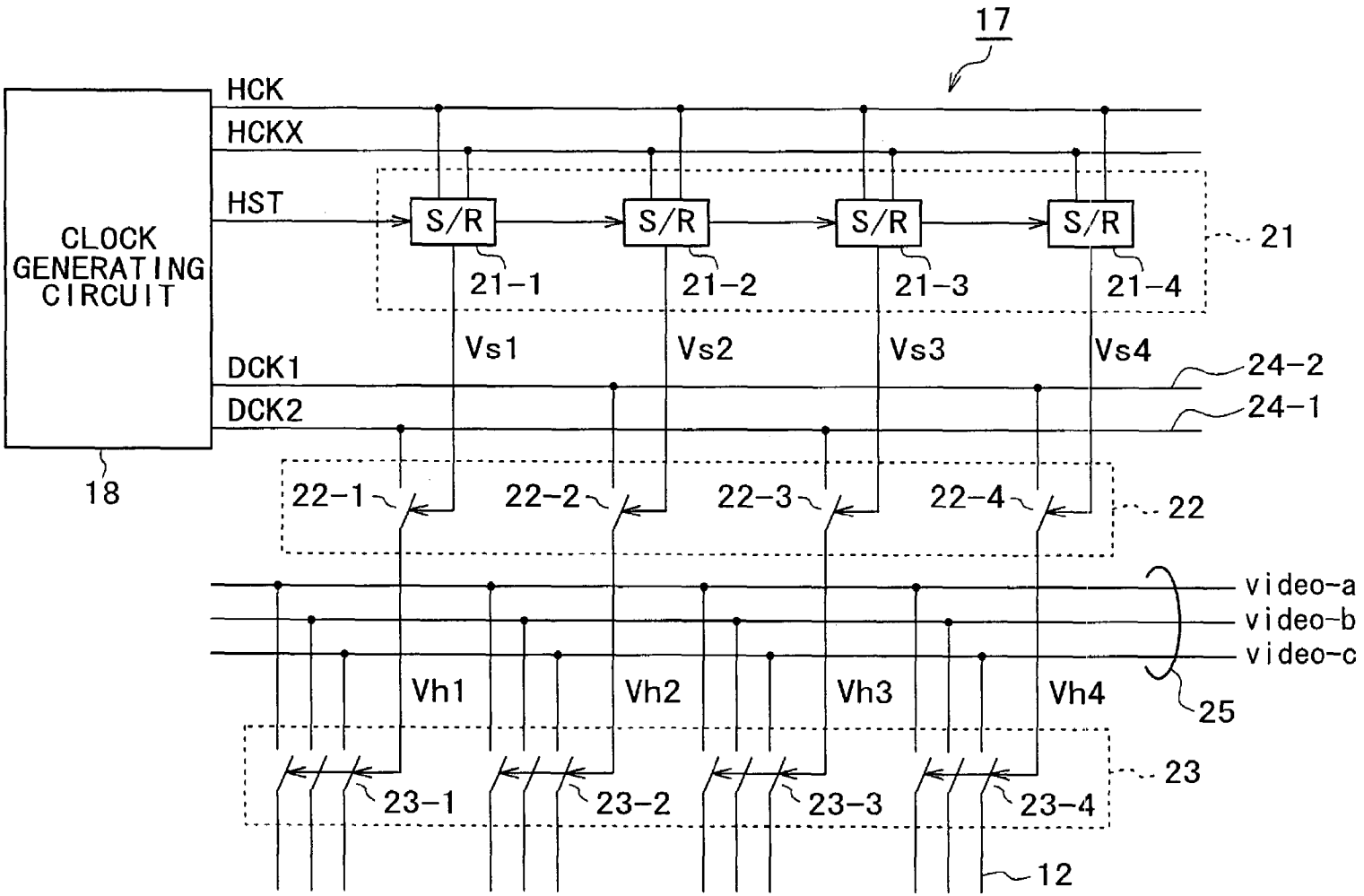
FIG. 5 is a circuit diagram showing a concrete configuration of a horizontal driving circuit shown in FIGS. 1A and 1B and FIG. 2.
Figure 6:
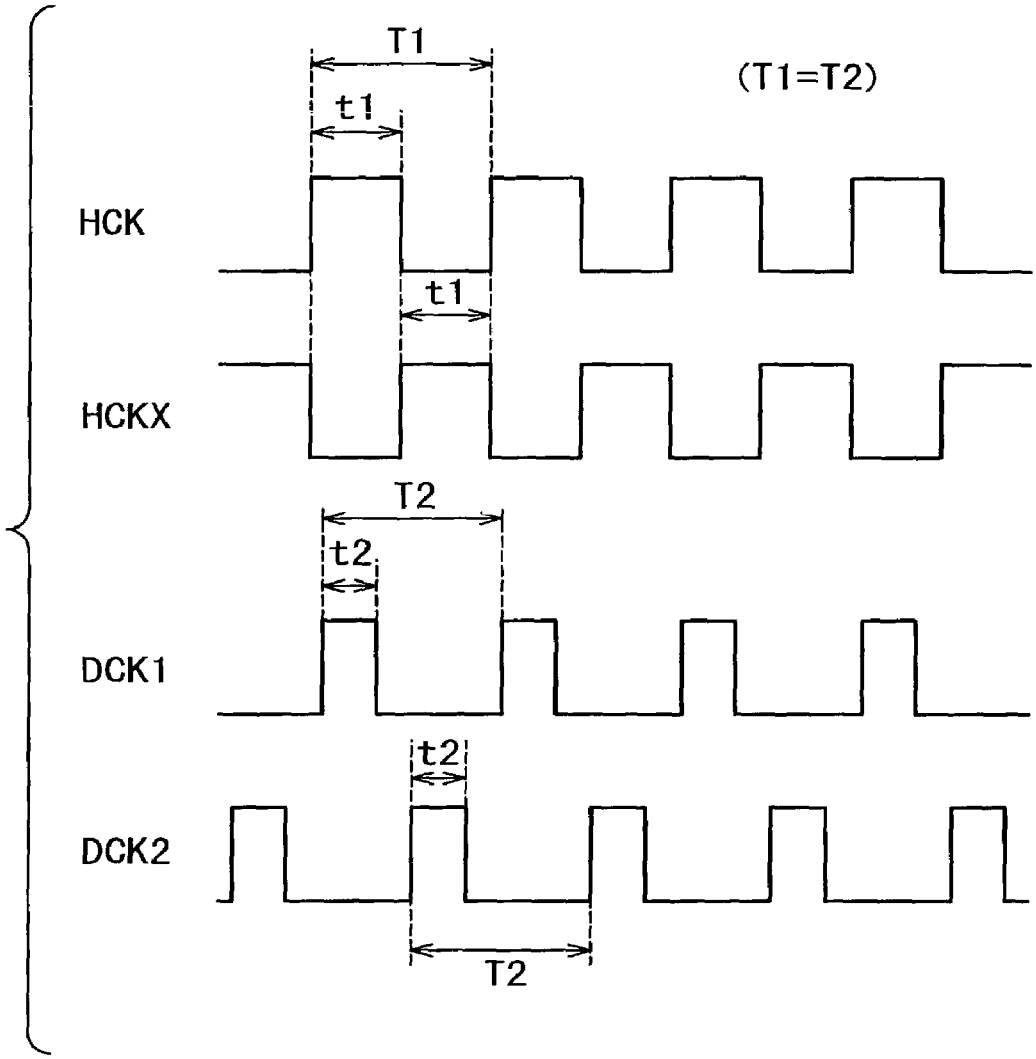
FIG. 6 is a waveform chart of assistance in explaining operation of the horizontal driving circuit shown in FIG. 5.

FIG. 5 is a schematic block diagram showing a concrete configuration of the horizontal driving circuit 17 included in the display apparatus shown in FIGS. 1A and 1B and FIG. 2. Incidentally, in this block diagram, the clock generating circuit 18 for supplying various clock pulses to the horizontal driving circuit 17 is added. The clock generating circuit 18 generates horizontal clocks HCK and HCKX that are opposite to each other in phase and serve as the basis for horizontal scanning, and then supplies the horizontal clocks HCK and HCKX to the horizontal driving circuit 17. The clock generating circuit 18 also supplies a horizontal start pulse HST to the horizontal driving circuit 17. Further, as shown in a timing chart of FIG. 6, the clock generating circuit 18 generates a pair of clocks DCK1 and DCK2 having the same cycle as the horizontal clocks HCK and HCKX (T1=T2) and having a lower duty ratio than the horizontal clocks HCK and HCKX, and then supplies the clocks DCK1 and DCK2 to the horizontal driving circuit 17. The duty ratio is a ratio of a pulse width t to a pulse repetition cycle T of a pulse waveform. In this example, the duty ratio (t1/T1) of the horizontal clocks HCK and HCKX is 50%, and the duty ratio (t2/T2) of the clocks DCK1 and DCK2 is lower than that of the horizontal clocks HCK and HCKX. That is, the pulse width t2 of the clocks DCK1 and DCK2 is set narrower than the pulse width t1 of the horizontal clocks HCK and HCKX.

The horizontal driving circuit 17 sequentially samples input video signals video-a, video-b, and video-c divided in three systems in each H (H denotes a horizontal scanning period), and simultaneously writes three pixels of pixels 11 selected in a unit of a row by the vertical driving circuit 16. In this example, the horizontal driving circuit 17 uses a clock driving method. The horizontal driving circuit 17 includes the shift register 21, the non-overlap shaping switch group 22, and the sampling switch group 23. Each of switches 23-1, 23-2, 23-3, and 23-4 included in the sampling switch group 23 binds three signal lines 12 together, and simultaneously samples the video signals video-a, video-b, and video-c divided in the three systems.

The shift register 21 includes multistage-connected shift stages (S/R) 21-1 to 21-4. When the horizontal start pulse HST is supplied to the shift register 21, the shift register 21 performs shift operation in synchronism with the horizontal clocks HCK and HCKX opposite to each other in phase. Thereby, as shown in a timing chart of FIG. 7, the shift stages 21-1 to 21-4 of the shift register 21 sequentially output shift pulses Vs1 to Vs4 having a pulse width equal to the cycle of the horizontal clocks HCK and HCKX.

The shaping switch group 22 includes switches 22-1 to 22-4 corresponding to the stages of the shift register 21. The switches 22-1 to 22-4 are alternately connected at one terminal thereof to clock lines 24-1 and 24-2 that transmit the clocks DCK2 and DCK1 from the clock generating circuit 18. Specifically, the switches 22-1 and 22-3 are connected at one terminal thereof to the clock line 24-1, and the switches 22-2 and 22-4 are connected at one terminal thereof to the clock line 24-2.

The switches 22-1 to 22-4 of the shaping switch group 22 are supplied with the shift pulses Vs1 to Vs4 sequentially outputted from the shift stages 21-1 to 21-4 of the shift register 21. When supplied with the shift pulses Vs1 to Vs4 from the shift stages 21-1 to 21-4 of the shift register 21, the switches 22-1 to 22-4 of the shaping switch group 22 are sequentially turned on in response to the shift pulses Vs1 to Vs4 to alternately extract the clocks DCK2 and DCK1 opposite to each other in phase.

The sampling switch group 23 includes switches 23-1 to 23-4. The switches 23-1 to 23-4 are each connected to three video lines 25 for inputting the video signals video-a, video-b, and video-c. The clocks DCK2 and DCK1 extracted by the switches 22-1 to 22-4 of the shaping switch group 22 are supplied as sampling pulses Vh1 to Vh4 to the switches 23-1 to 23-4 of the sampling switch group 23.

When supplied with the sampling pulses Vh1 to Vh4 from the switches 22-1 to 22-4 of the shaping switch group 22, the switches 23-1 to 23-4 of the sampling switch group 23 are sequentially turned on in response to the sampling pulses Vh1 to Vh4 to simultaneously sample the video signals video-a, video-b, and video-c inputted through the three video lines 25. The switches 23-1 to 23-4 of the sampling switch group 23 then supply the sampled video signals to the signal lines 12 of the pixel array unit.

The thus formed horizontal driving circuit 17 according to the present embodiment alternately extracts the pair of clocks DCK2 and DCK1 in synchronism with the shift pulses Vs1 to Vs4 and directly uses the clocks DCK2 and DCK1 as the sampling pulses Vh1 to Vh4, rather than using the shift pulses Vs1 to Vs4 sequentially outputted from the shift register 21 as the sampling pulses Vh1 to Vh4. Thereby, variations of the sampling pulses Vh1 to Vh4 can be reduced. As a result, a ghost caused by variations of the sampling pulses Vh1 to Vh4 can be eliminated.

In addition, rather than extracting the horizontal clocks HCKX and HCK serving as a basis for the shift operation of the shift register 21 and using the horizontal clocks HCKX and HCK as the sampling pulses Vh1 to Vh4 as in the related art, the horizontal driving circuit 17 according to the present embodiment separately generates the clocks DCK2 and DCK1 having the same cycle as the horizontal clocks HCKX and HCK and having a lower duty ratio than the horizontal clocks HCKX and HCK, and extracts the clocks DCK2 and DCK1 to use the clocks DCK2 and DCK1 as the sampling pulses Vh1 to Vh4. Thus, the following effects can be obtained.

Figure 7:
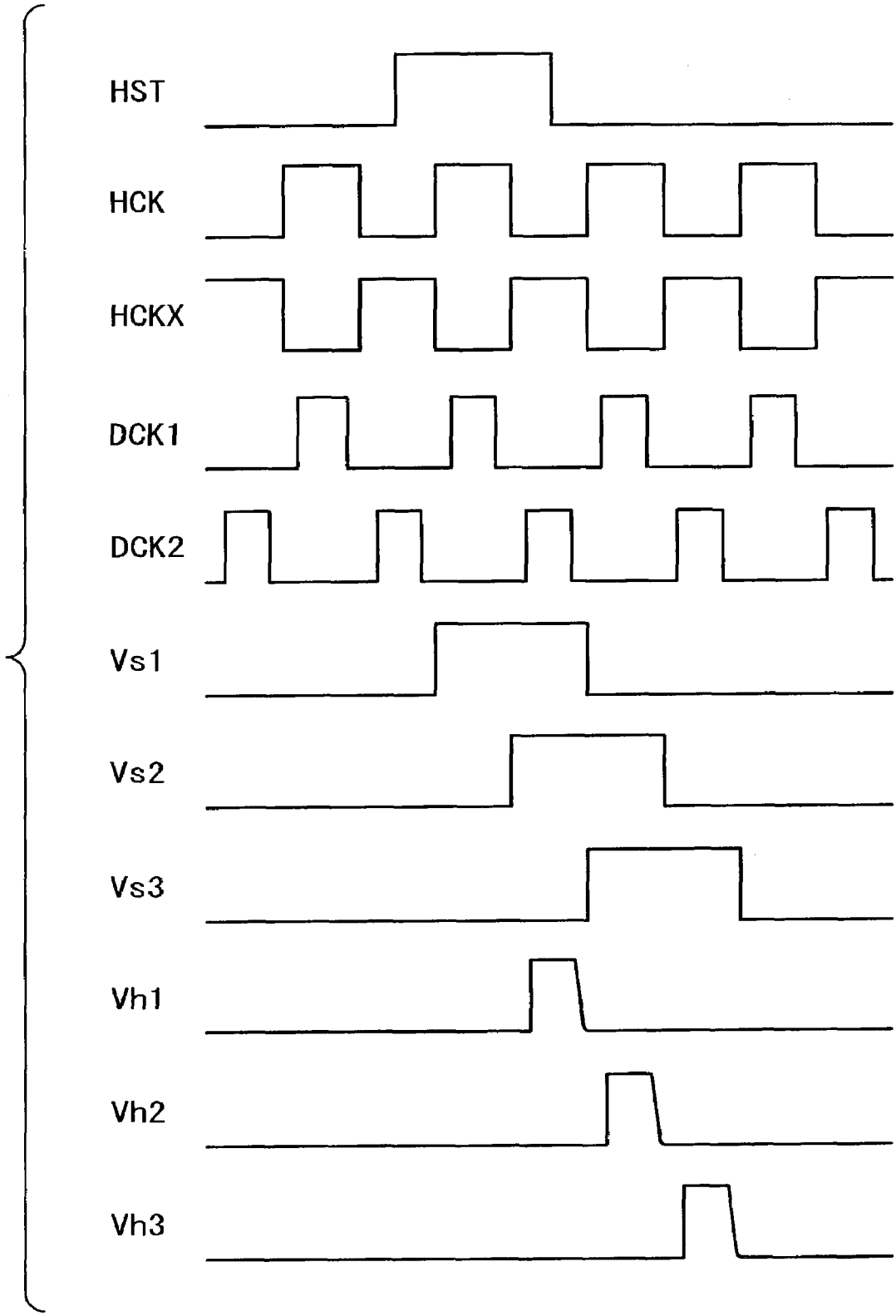
FIG. 7 is a waveform chart of assistance in explaining operation of the horizontal driving circuit shown in FIG. 5.
Figure 8:
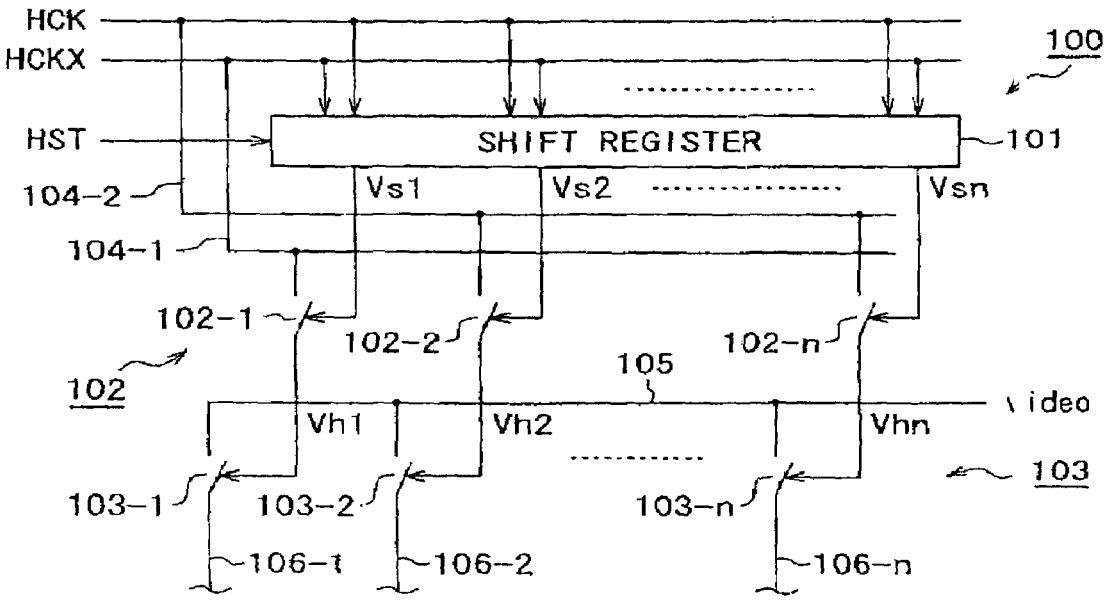
PRIOR ART F I G. 8
FIG. 8 is a circuit diagram showing an example of a conventional display apparatus.
Figure 9:
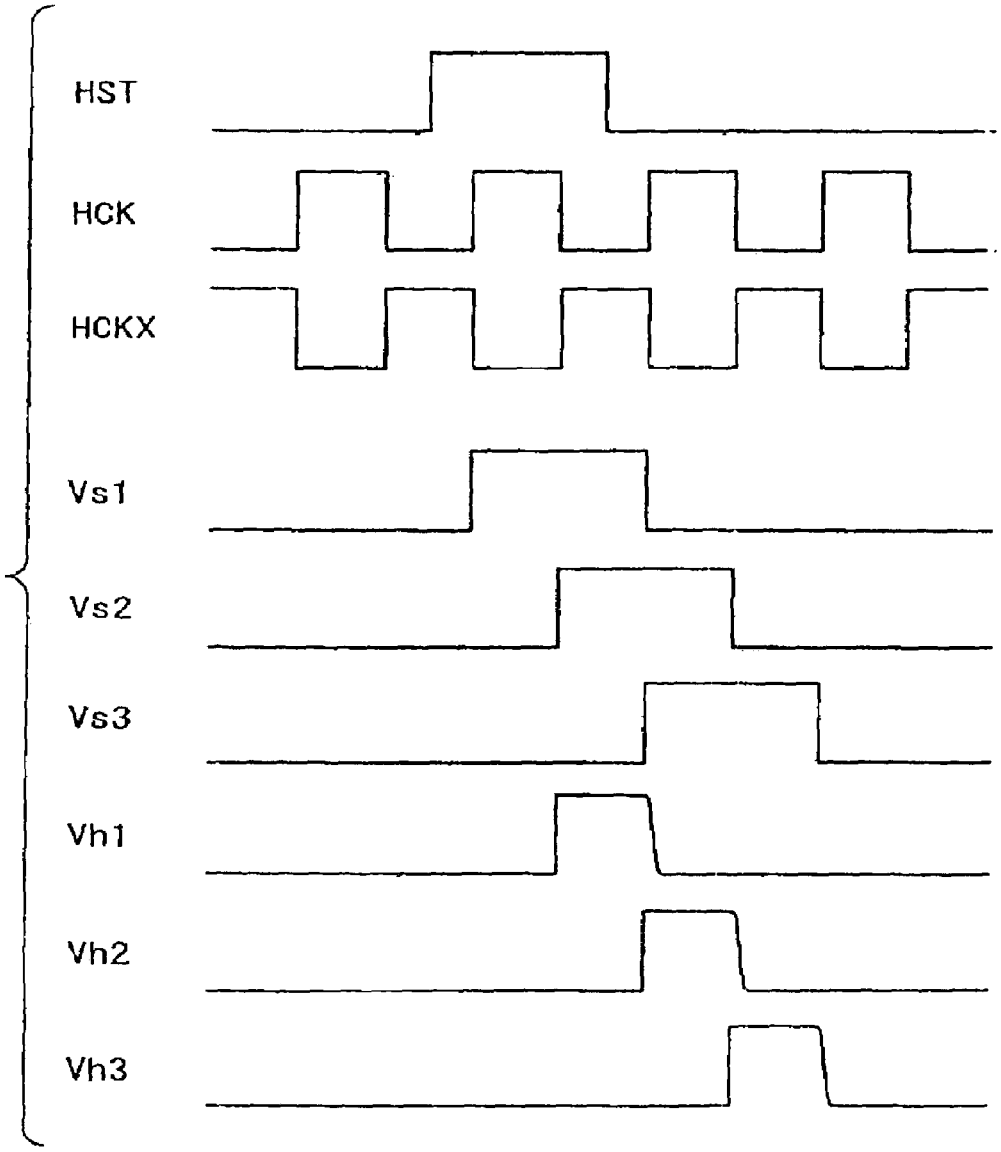
PRIOR ART F I G. 9
FIG. 9 is a waveform chart of assistance in explaining operation of the display apparatus shown in FIG. 8.
Figure 10:
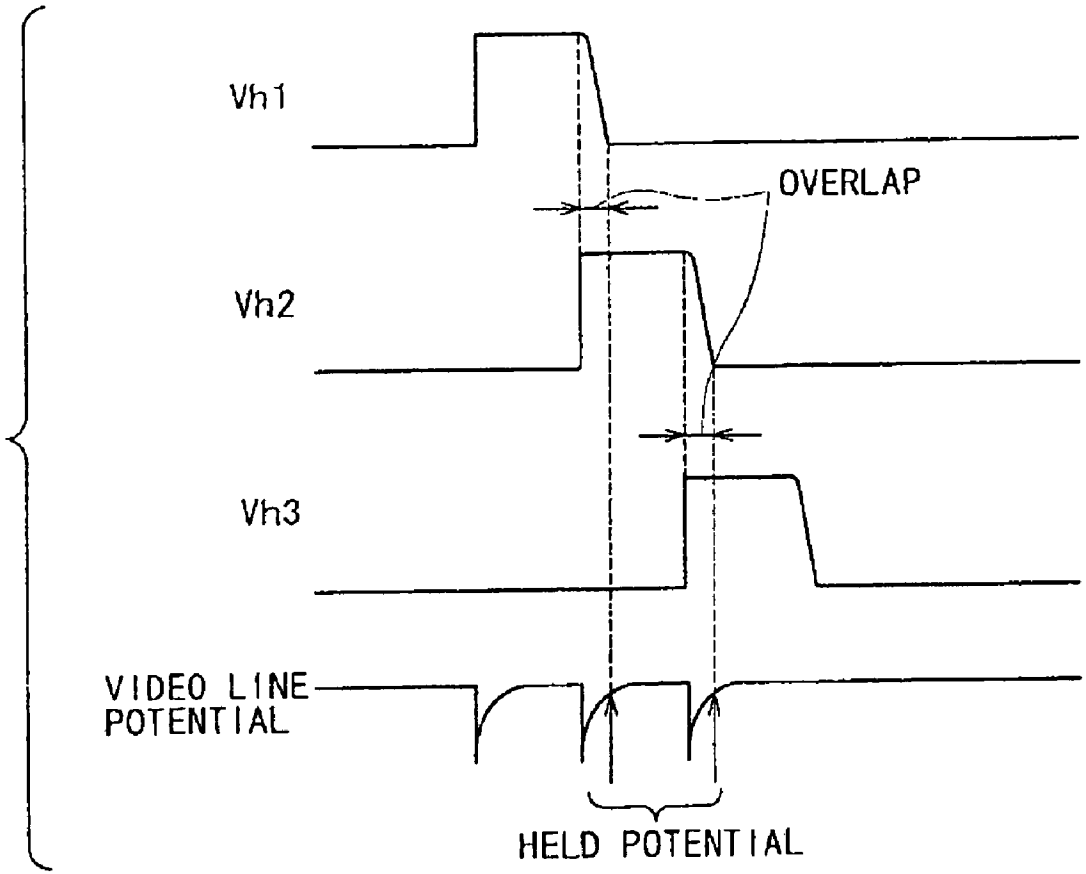
PRIOR ART FIG. 10
FIG. 10 is a waveform chart of assistance in explaining operation of the display apparatus shown in FIG. 8.
Figure 11:
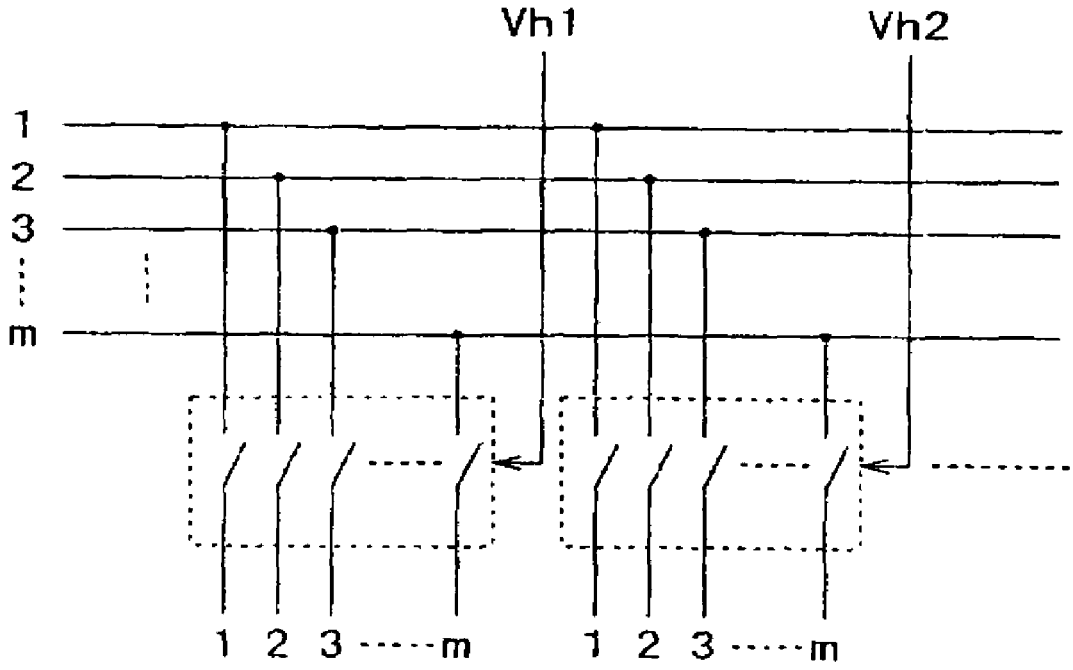
PRIOR ART FIG. 11
FIG. 11 is a schematic diagram illustrating a conventional method of simultaneously driving a plurality of pixels.
Figure 12A:
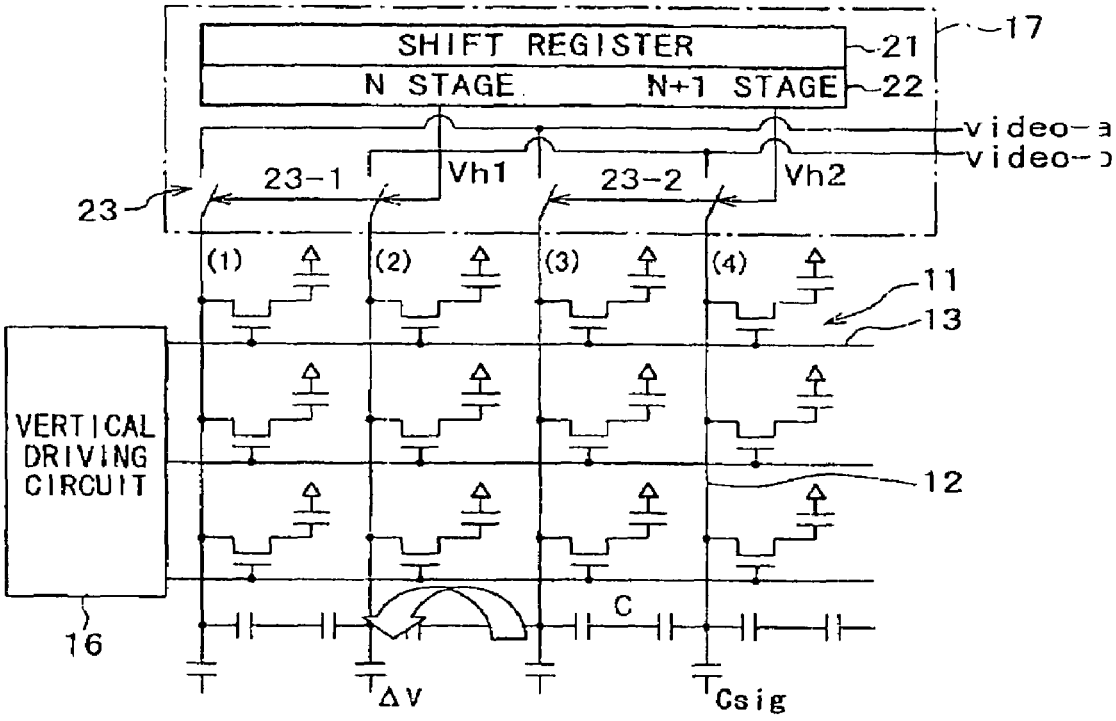
PRIOR ART FIG. 12A
FIGS. 12A and 12B are schematic diagrams showing an example of a conventional display apparatus.
Figure 12B:
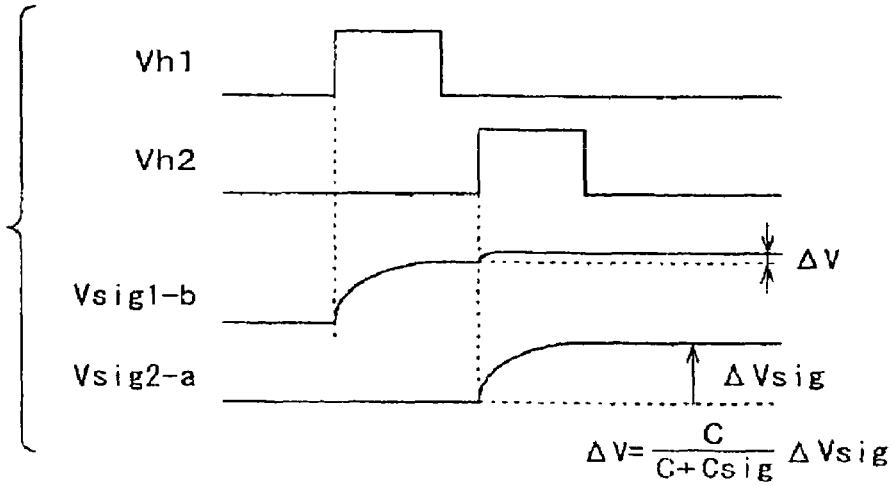
PRIOR ART FIG. 12B
Figure 13:
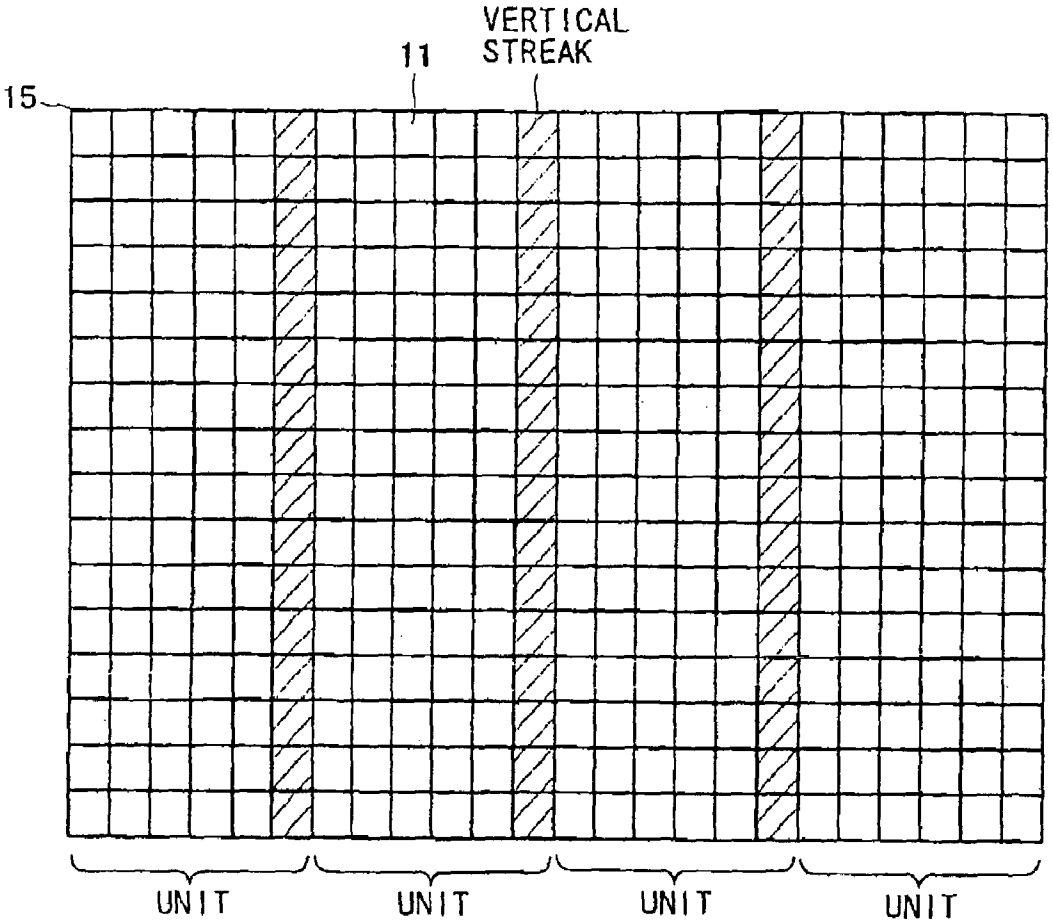
PRIOR ART FIG. 13
FIG. 13 is a schematic diagram showing a problem of the conventional display apparatus.

As is particularly clear from the timing chart of FIG. 7, even when pulse delay is caused by wiring resistance, parasitic capacitance, and the like and waveforms of the extracted clocks DCK2 and DCK1 are rounded in a transmission process from the extraction of the clocks DCK2 and DCK1 by the switches 22-1 to 22-4 of the shaping switch group 22 to the supply of the clocks DCK2 and DCK1 to the switches 23-1 to 23-4 of the sampling switch group 23, each of the extracted clocks DCK2 and DCK1 has a waveform in a perfectly non-overlapping relation with the preceding and succeeding pulses.

The clocks DCK2 and DCK1 having the perfectly non-overlapping waveform are used as the sampling pulses Vh1 to Vh4. Directing attention to a kth stage in the sampling switch group 23, the sampling of the video signal "video" by the sampling switch in the kth stage can surely be completed before the turning on of the sampling switch in a (k+1)th stage.

Thereby, even when charge and discharge noise is superimposed on the video lines 25 at an instant of the turning on of each of the switches 23-1 to 23-4 of the sampling switch group 23, sampling in that stage is surely performed before charge and discharge noise is caused by switching in the next stage. It is therefore possible to prevent sampling of the charge and discharge noise. As a result, in horizontal driving, perfect non-overlap sampling can be realized between sampling pulses, and hence occurrence of a vertical streak due to overlap sampling can be prevented.

As described above, according to the present invention, by connecting a parasitic capacitance interposed between adjacent signal lines to wiring of low impedance and thus attenuating coupling between the adjacent signal lines, it is possible to eliminate a one-dot vertical streak in each unit caused by non-overlap sampling driving introduced as a measure against the vertical streak and ghost. It is also possible to eliminate the defect of a one-dot vertical streak in each unit when a dot checkered pattern is displayed. Since this method eliminates the disadvantages of non-overlap sampling driving, it is possible to increase an amount of non-overlap and make optimum design for the ghost margin and the vertical streak defect. Since the need for adjusting a precharge signal level for the vertical streak defect is eliminated, it is possible to set an optimum precharge level for other image defects.

While a preferred embodiment of the invention has been described using specific terms, such description is for illustrative purposes only, and it is to be understood that changes and variations may be made without departing from the spirit or scope of the following claims.

What is claimed is:

1. A display apparatus comprising:

a pixel array unit having gate lines in a form of rows, signal lines in a form of columns, and pixels arranged in a form of a matrix at intersections of the gate lines and the signal lines;

a vertical driving circuit connected to the gate lines, for sequentially selecting rows of the pixels; and a horizontal driving circuit connected to the signal lines, for operating on the basis of a predetermined clock signal and sequentially writing a video signal to pixels of a selected row;

wherein said horizontal driving circuit includes:

a shift register for performing shift operation in synchronism with said clock signal and sequentially outputting shift pulses from respective shift stages;

a shaping switch group for shaping said shift pulses sequentially outputted from said shift register and sequentially outputting non-overlap sampling pulses temporally separated from each other; and a sampling switch group for sequentially sampling the input video signal in a non-overlapping manner in response to said sampling pulses and supplying the sampled video signal to each of the signal lines; and a capacitance interposed between adjacent signal lines is connected to wiring of lower impedance than a signal line side, thereby attenuating capacitive coupling between the adjacent signal lines and thus suppressing the potential variation of the video signal sampled in a non-overlapping manner and supplied to the signal lines; and wherein the capacitance interposed between the signal lines is formed by a conductor film disposed over the adjacent signal lines via an insulating film, and the conductor film is connected to the wiring of lower impedance than the signal line side, thereby attenuating the capacitive coupling between the adjacent signal lines; and wherein said pixel includes a pixel electrode connected to a signal line via a switching element and a counter electrode opposed to the pixel electrode with electro-optical material between the counter electrode and the pixel electrode; and said conductor film is connected to a wiring for supplying a predetermined potential to the film.

2. A display apparatus comprising:

a pixel array unit having gate lines in a form of rows, signal lines in a form of columns, and pixels arranged in a form of a matrix at intersections of the gate lines and the signal lines;

a vertical driving circuit connected to the gate lines, for sequentially selecting rows of the pixels; and a horizontal driving circuit connected to the signal lines, for operating on the basis of a predetermined clock signal and sequentially writing a video signal to pixels of a selected row;

wherein said horizontal driving circuit includes:

a shift register for performing shift operation in synchronism with said clock signal and sequentially outputting shift pulses from respective shift stages;

a shaping switch group for shaping said shift pulses sequentially outputted from said shift register and sequentially outputting non-overlap sampling pulses temporally separated from each other; and a sampling switch group for sequentially sampling the input video signal in a non-overlapping manner in response to said sampling pulses and supplying the sampled video signal to each of the signal lines; and a capacitance interposed between adjacent signal lines; and wherein the capacitance interposed between the signal lines is affected by a conductor film disposed over the adjacent signal lines via an insulating film, and the conductor film is connected to the wiring of lower impedance than the signal lines, thereby attenuating the capacitive coupling between the adjacent signal lines and thus suppressing the potential variation of the video signal sampled in a non-overlapping manner and supplied to the signal lines.

3. A display apparatus as claimed in claim 2, wherein, said conductor film is connected to a wiring for supplying a predetermined potential to the film.

4. A display apparatus as claimed in claim 2, wherein said conductor film is formed by polysilicon for blocking light between the adjacent signal lines.

5. A display apparatus comprising:

a pixel array unit having gate lines in a form of rows, signal lines in a form of columns, and pixels arranged in a form of a matrix at intersections of the gate lines and the signal lines;

a vertical driving circuit connected to the gate lines, for sequentially selecting rows of the pixels; and a horizontal driving circuit connected to the signal lines, for operating on the basis of a predetermined clock signal and sequentially writing a video signal to pixels of a selected row;

wherein said display apparatus further comprises:

a conductor film disposed over adjacent signal lines via an insulating film so as to at least partially overlap two adjacent signal lines, and the conductor film connected to a wiring of lower impedance than the signal lines, thereby attenuating the capacitive coupling between the adjacent signal lines and thus suppressing the potential variation of the video signal sampled in a non-overlapping manner and supplied to the signal lines.

6. A display apparatus according to claim 5, wherein:

said conductor film is connected to a wiring for supplying a predetermined potential to the film.

7. A display apparatus as claimed in claim 6, wherein said conductor film is formed by polysilicon for blocking light between the adjacent signal lines.

* * * * *